US006260987B1

(12) United States Patent
Wu

(10) Patent No.: US 6,260,987 B1
(45) Date of Patent: Jul. 17, 2001

(54) ASSEMBLED DEVICE OF DECORATING LAMPS

(76) Inventor: Jeng-shyong Wu, No. 14, Alley 1, Lane 326, Shih-Pin Rd., Hsinchu (TW)

( * ) Notice: Subject to any disclaimer, the term of this patent is extended or adjusted under 35 U.S.C. 154(b) by 0 days.

(21) Appl. No.: 09/343,193

(22) Filed: Jun. 30, 1999

(51) Int. Cl.[7] ..... F21P 1/00
(52) U.S. Cl. ..... 362/252; 362/124; 362/806
(58) Field of Search ..... 362/124, 249, 362/252, 806, 807, 808

(56) References Cited

U.S. PATENT DOCUMENTS

| | | | | |
|---|---|---|---|---|
| 1,723,471 | * | 8/1929 | Dunham | 362/252 |
| 4,769,749 | * | 9/1988 | Felski | 362/806 |
| 4,890,206 | * | 12/1989 | Lee | 362/252 |
| 5,077,646 | * | 12/1991 | Parsons | 362/252 |
| 5,534,315 | * | 7/1996 | Witte | 362/808 |
| 5,544,031 | * | 8/1996 | Blanton | 362/249 |
| 5,595,439 | * | 1/1997 | Maddock et al. | 362/806 |
| 5,613,764 | * | 3/1997 | O'Brien | 362/252 |
| 5,924,786 | * | 7/1999 | Lin | 362/252 |
| 5,951,147 | * | 9/1999 | Ho | 362/252 |
| 6,015,218 | * | 1/2000 | Snell | 362/249 |
| 6,017,134 | * | 1/2000 | Wang | 362/252 |
| 6,062,707 | * | 5/2000 | Wang | 362/249 |

* cited by examiner

*Primary Examiner*—Sandra O'Shea
*Assistant Examiner*—Peggy G. Neils
(74) *Attorney, Agent, or Firm*—Dougherty & Troxell

(57) ABSTRACT

An assembly of decorating lamps is formed by a string of decorating bulbs mounted on a substrate. The string of decorating bulbs are formed by a plurality of connected bulbs, lamp heads, and lamp seats, conductive wires, a plug, a tail plug, and a controller. Fixing devices are formed on the substrate to enable a plurality of lamp seats or conductive wires to be fixed to the substrate and arranged as a predetermined pattern or character so as to attain an effect of decoration.

7 Claims, 13 Drawing Sheets

ASSEMBLED DEVICE OF DECORATING LAMPS

FIELD OF THE INVENTION

The present invention relates to an assembled device of decorating lamps, and especially to a decorating lamp, wherein a plurality of lamp seats or conductive wires are fixed to the substrate and arranged in a predetermined pattern or character to as to attain a decorative effect.

BACKGROUND OF THE INVENTION

In general festivals, some model animals, such as tiger, horse, leopard, are presented in a parade, especially, they are often displayed at night (for example the decorative lantern in the Chinese Lantern Festival), the interior of the models need to have lamps for illumination.

In the past, some decorative lamps were installed within the models. A string of bulbs are arranged for emitting light. However, the fixing device of the bulbs is very easy, wherein a supporter is firstly formed, and then tied to the bulbs. However, such an installation has a bad fastening. Moreover, the installation of bulbs is time-consuming, and may easily become loose. Thus, it can only be displayed in a stationary state and the effect of displaying is finite.

SUMMARY OF THE INVENTION

Accordingly, the primary object of the present invention is to provide an assembled device formed by a string of decorating lamps and a substrate. The string of decorating lamps is formed by connecting a plurality of bulbs, lamp heads, and lamp seats, conductive wires, a plug, a tail plug, or controller. Fixing devices are formed on the substrate. A plurality of lamp seats or conductive wires are fixed to the substrate and arranged in a predetermined pattern or character so as to attain a decorative effect.

Another object of the present invention is to provide an assembled device of decorating lamps, wherein the lamp seat has a circular periphery, and two opposite sides of said lamp seat are formed with parallel longitudinal flanges, respectively. The two flanges are formed with a longitudinal groove for engaging into preset holes. Therefore, the installation is very convenient.

Another object of the present invention is to provide an assembled device of decorating lamps, wherein the substrate is a transparent or opaque plastic plate, and is coated with colors according to patterns or characters.

A further object of the present invention is to provide an assembled device of decorating lamps, wherein a plurality of substrates are connected by fixing devices so as to form a three dimensional device in order to attain a preferred decorating effect.

The various objects and advantages of the present invention will be more readily understood from the following detailed description when read in conjunction with the appended drawing.

DETAILED DESCRIPTION OF THE PREFERRED EMBODIMENTS

Figure 1:
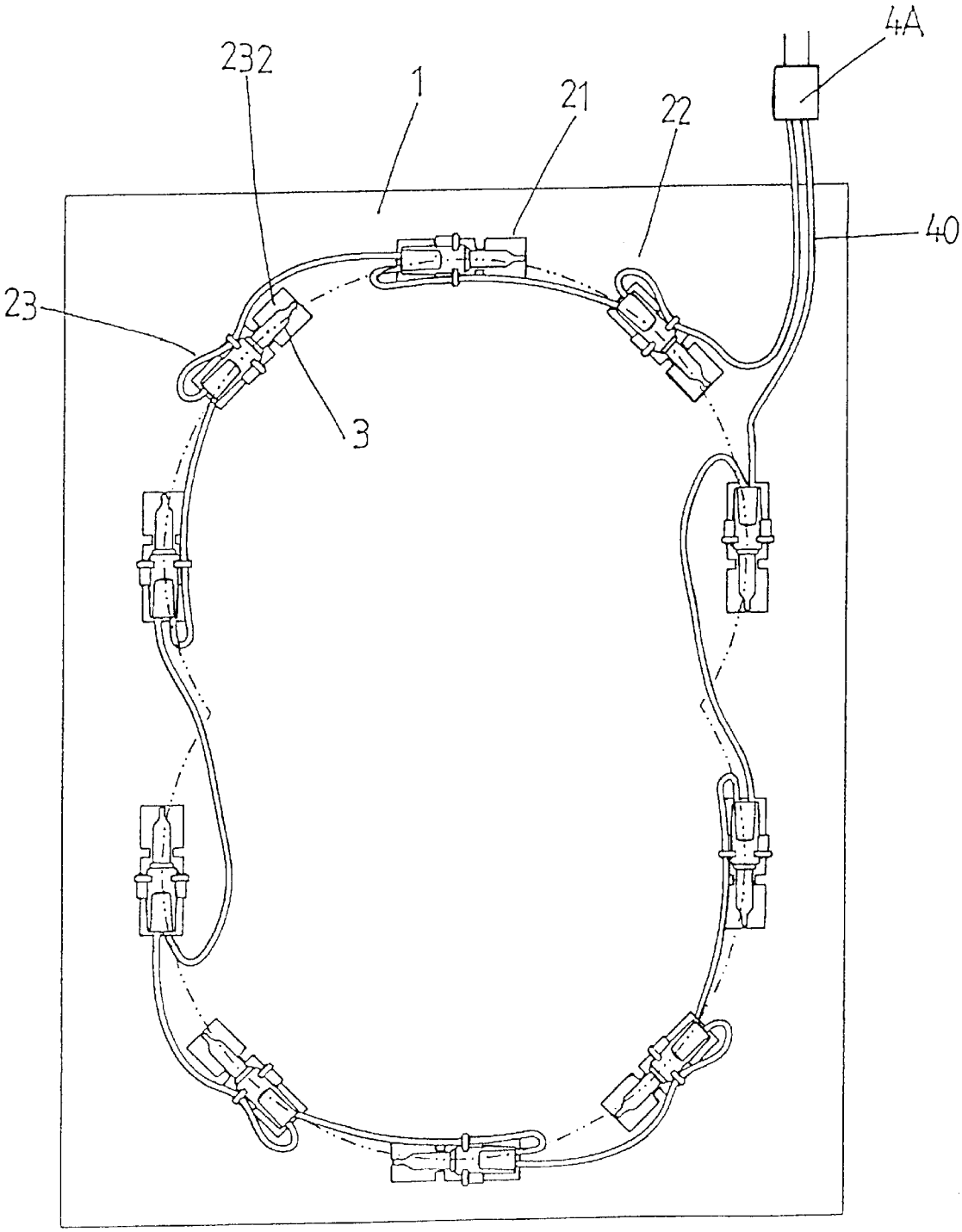
FIG. 1 is a plan view of the present invention.
Figure 2A:
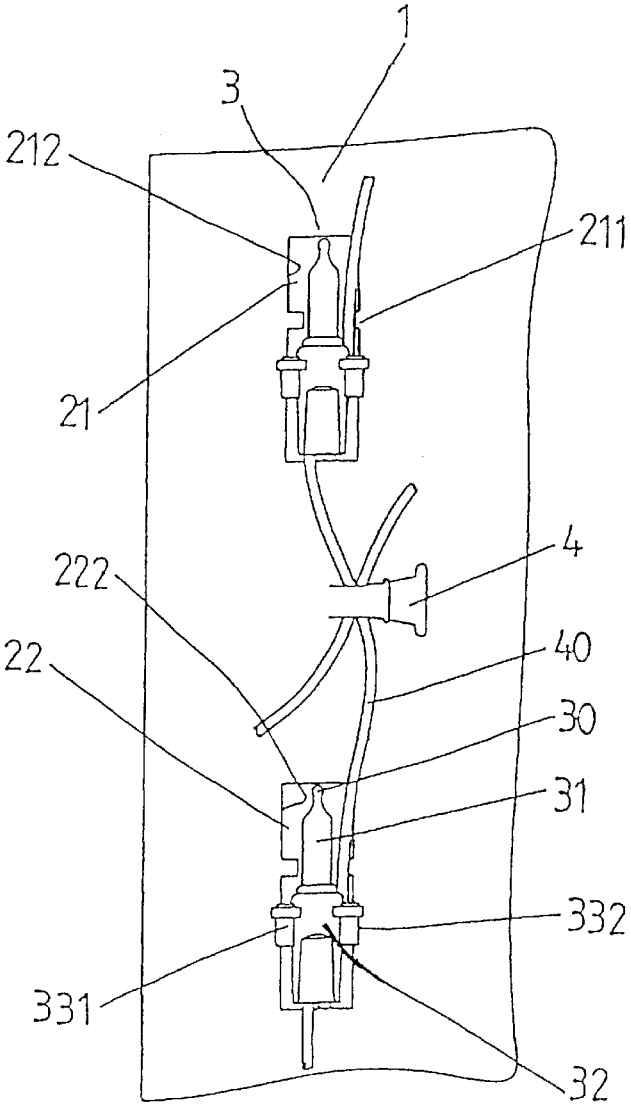
FIG. 2A is a plan view showing the substrate of the present invention being installed with lamps.
Figure 2C:
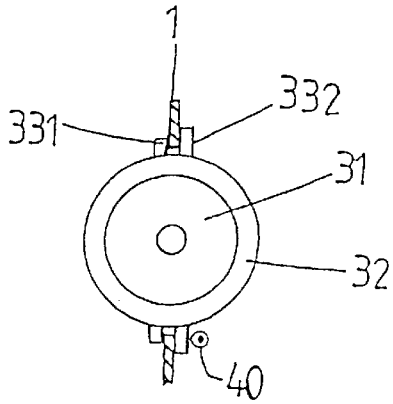
FIG. 2C is a top view of the assembly of FIG. 2A.
Figure 2B:
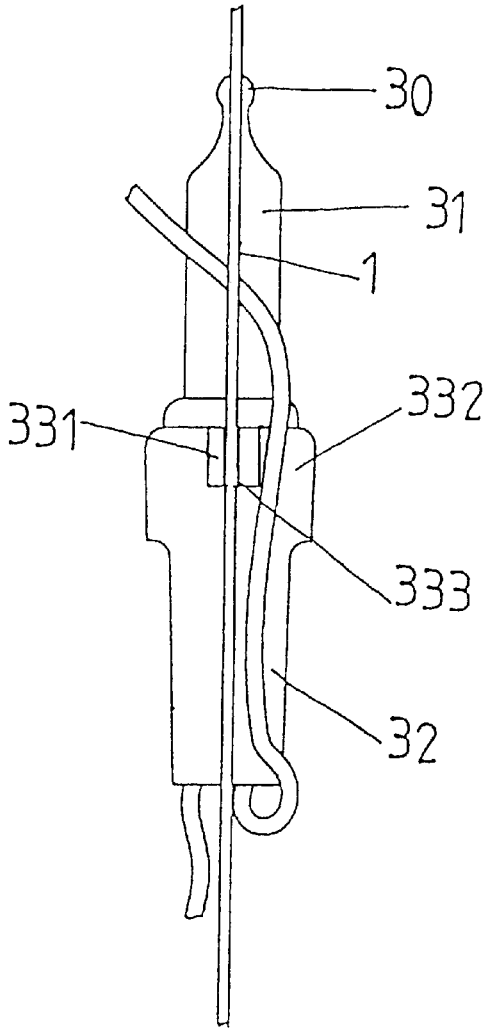
FIG. 2B is a side view showing that the substrate of the present invention is installed with lamps at part thereof.
Figure 2D:
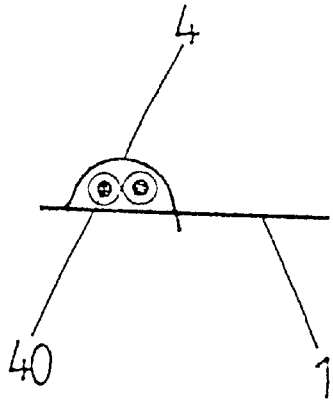
FIG. 2D is a partial top view showing that the substrate in FIG. 2A installed with long shape tongue pieces.

As shown in FIG. 1, the assembled device of decorating lamps of the present invention is disclosed. The decorating lamp according to the present invention includes a substrate 1 on which are located a plurality of fixing devices 21, 22, 23. The fixing devices 21, 22 and 23 serve to fix lamp bodies 3 or conductive wires 40. The detailed structure thereof is shown in FIGS. 2A, 2B, 2C and 2D. As shown, the upper end of the lamp body 3 is a bulb 31, while the lower end thereof is a lamp seat 32 having a circular shape. Two sides of the lamp body 3 are formed with parallel flanges 331 and 332. A longitudinal groove 333 is formed between the parallel longitudinal flanges 331 and 332. The width of the groove 333 is larger than the thickness of the substrate 1. The fixing devices 21, 22, 23, . . . are formed as long holes in the substrate 1. The two sides of the holes have edges 212, 222, 232, the distance between the two opposite edges is slightly larger than the outer diameter of the lamp seat 32. Therefore, the longitudinal grooves 333 of the lamp seats are fixed to the sides of the holes 21, 22, 23, . . . and the bulb 31, lamp head 30 and the lamp seat 32 are vertically positioned and fixed in the substrate 1. The electric conductive wires 40 between two lamp bodies 3 are fixed by long tongue pieces 4. The other ends of the conductive wires 40 are connected to plugs for conduction.

Figure 3A:
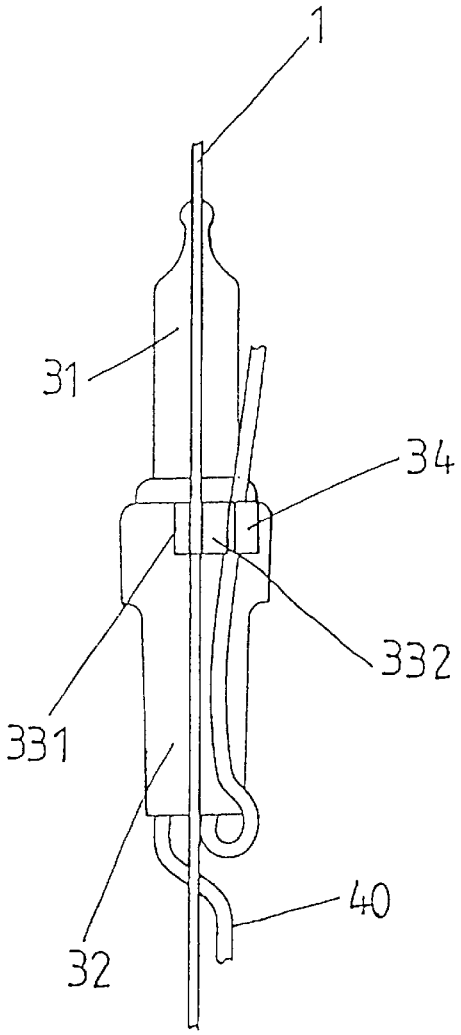
FIG. 3A shows the second embodiment of the present invention.
Figure 3B:
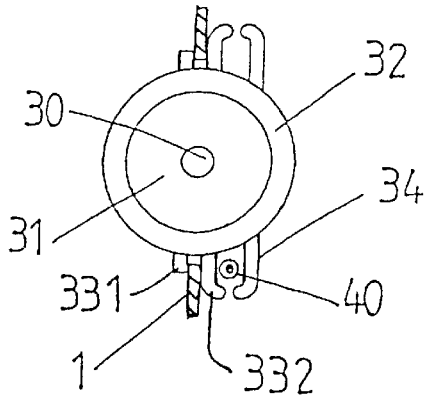
FIG. 3B is a top view of the assembly of FIG. 3A.
Figure 4A:
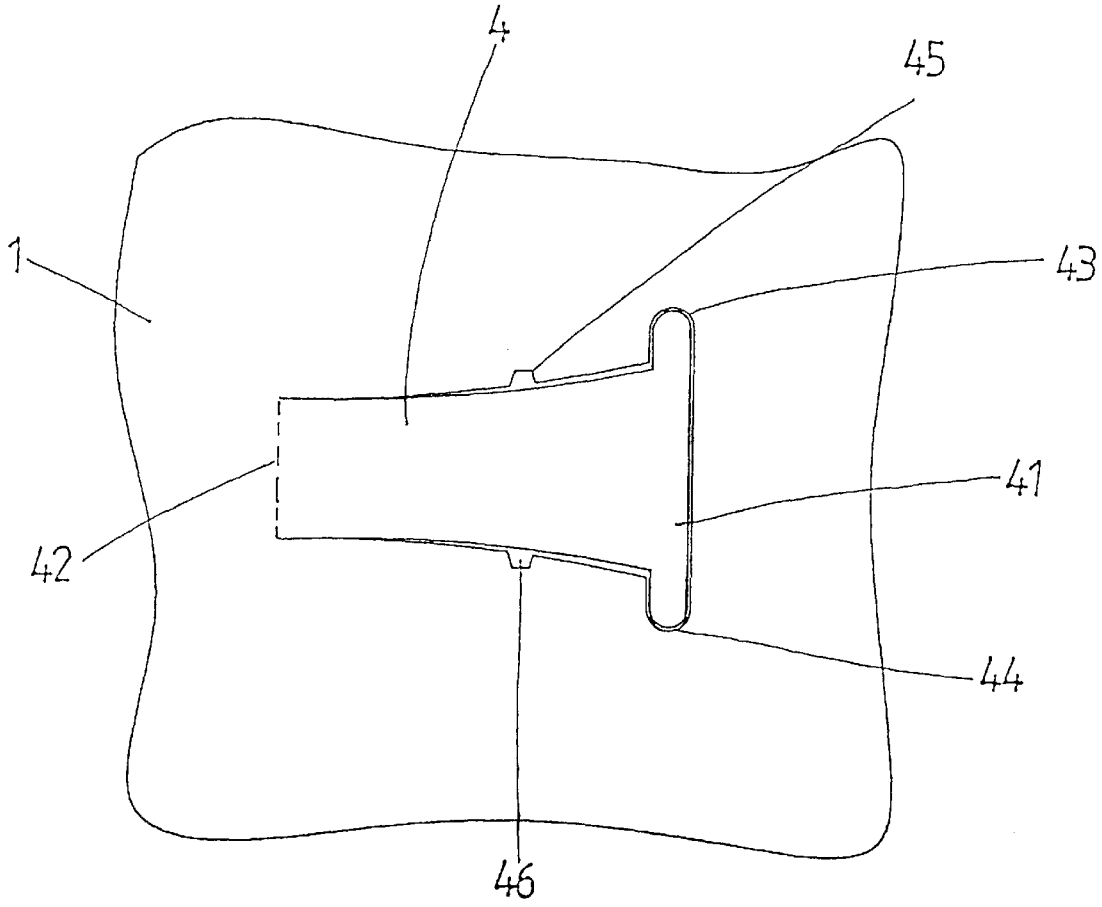
FIG. 4A is an enlarged plan view of the long shape tongue piece of the present invention.
Figure 4B:
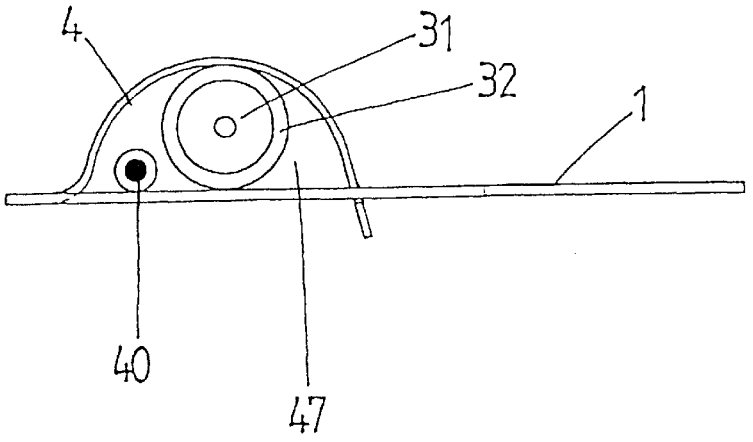
FIG. 4B is a side view showing the embodiment of FIG. 4A.

Referring to FIGS. 3A and 3B, in order to enhance the fastening of the conductive wire 40, the waist portion of the lateral side of the lamp seat 32 is formed with a hook 34 for installing the conductive wire 40 to the hook 34. Referring now to FIG. 4, the above long shape tongue piece 4 is formed by cutting directly on the substrate 1. The end portion 41 thereof is wider, while the root portion 42 thereof is a thinner connecting portion. Two opposite sides of the long shape tongue piece 4 from two flanges 43 and 44. After cutting the substrate 1, two opposite sides are formed with two notches 45 and 46. In use, the long shape tongue piece 4 is bent and the two flanges 43 and 44 are inserted into the two notches 45 and 46 for being fixed therewithin. Moreover, a gap 47 is formed between the long shape tongue piece 4 and the substrate 1. The gap 47 serves to fix the bulb 31, lamp seat 32, and conductive wires 40.

Some additional embodiments of the structure of the fixing device to fix the lamp on the substrate will be described in the following.

Figure 5:
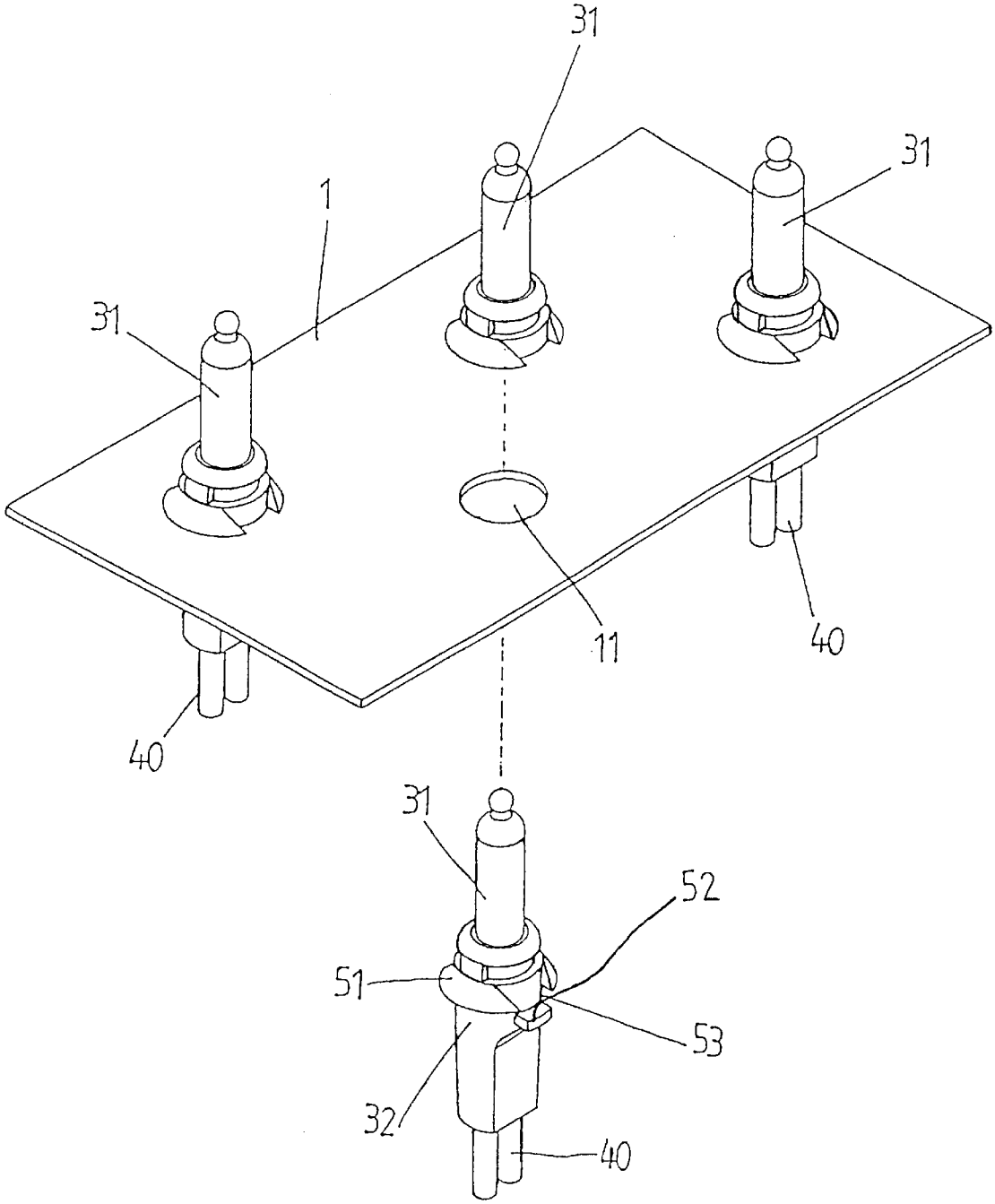
FIG. 5 is an exploded perspective view of the second embodiment of the present invention.
Figure 6A:
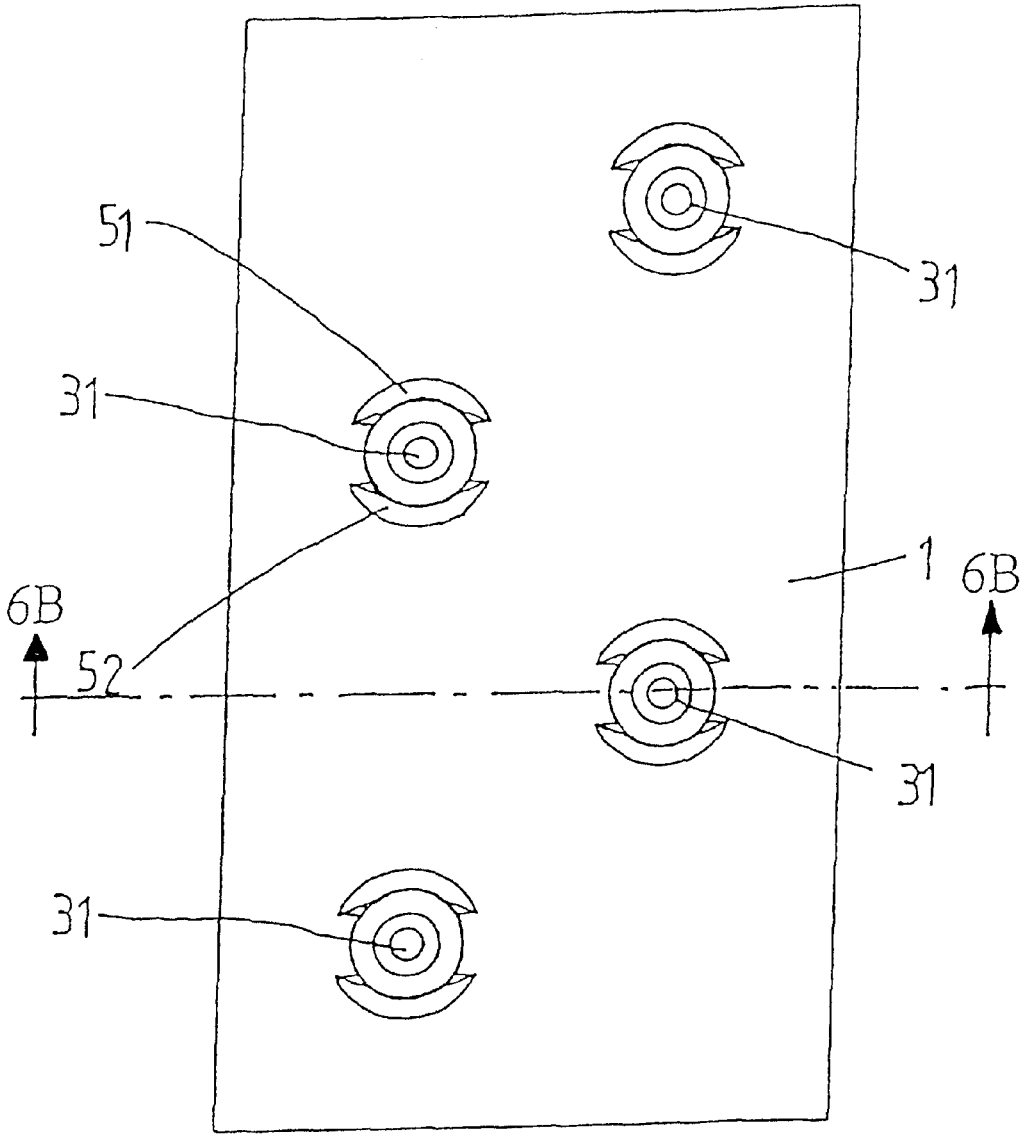
FIG. 6A is a top view of the assembly of FIG. 5.
Figure 6B:
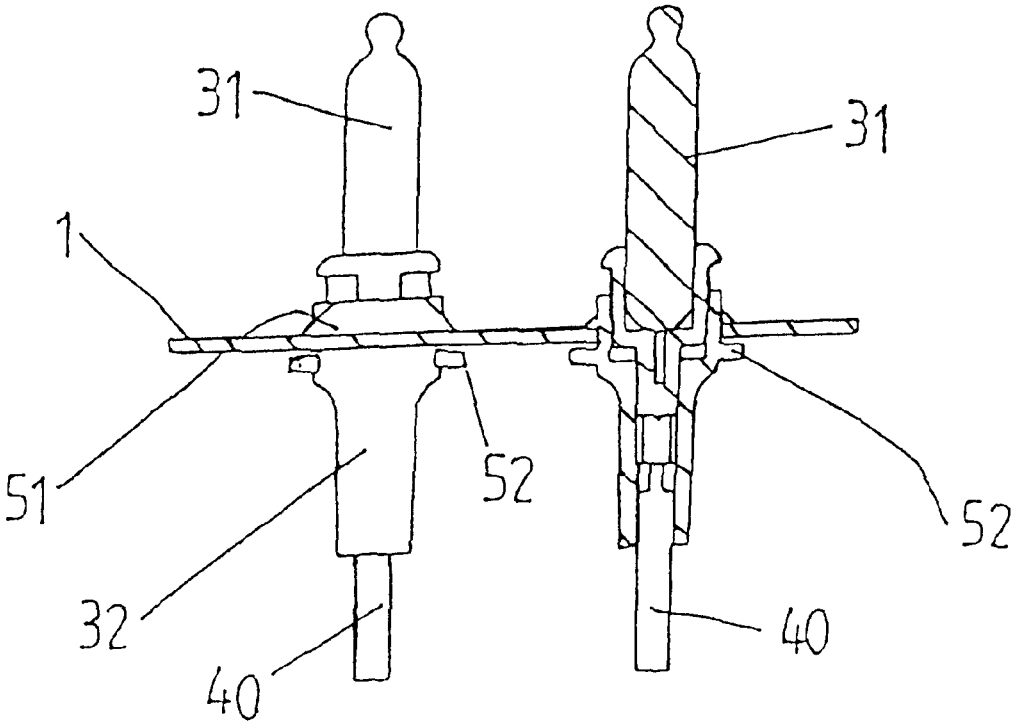
FIG. 6B is a cross-sectional view taken along lines 6B—6B of FIG. 6A.

As shown in FIGS. 5 and 6, two parallel transverse flanges 51 and 52 are formed on the waist of the lamp seat 32. A transverse groove 53 is formed between the flanges 51 and 52. The width of the groove 53 is slightly larger than the thickness of the substrate 1. The fixing devices of the substrate 1 are holes 11 in the substrate 1. The diameter of the round holes 11 is slightly larger than the outer diameter of the lamp seat 32 and smaller than the width of the two opposite sides of the flanges 51 and 52. The edge of the round hole 11 may be engaged into the groove 53 between the two flanges. The bulb 31 and the lamp seat 32 are fixed to the round hole 11 so as to be vertically fixed to the substrate 1.

Figure 7:
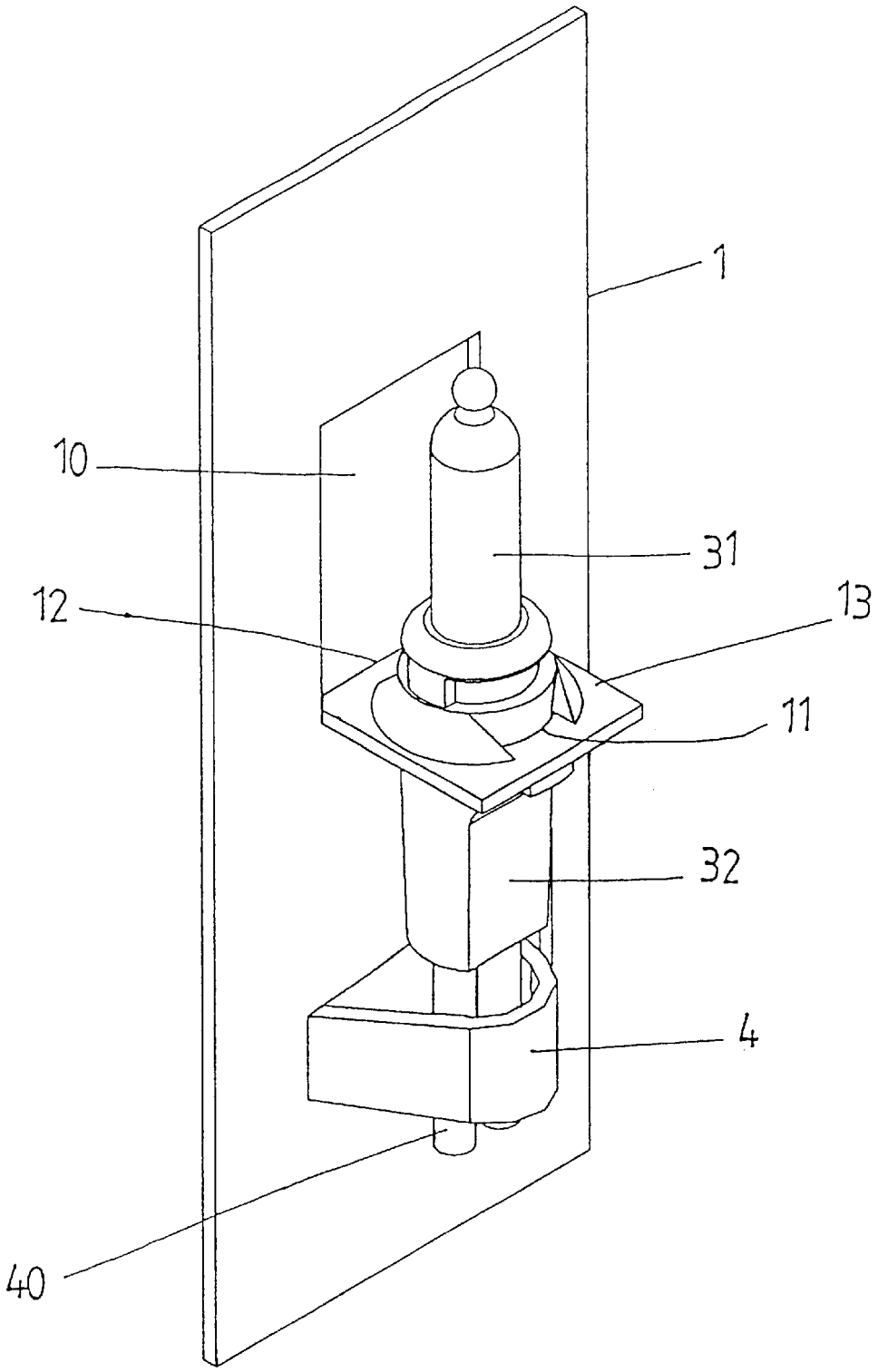
FIG. 7 is an assembled perspective view of the third embodiment according to the present invention.

Moreover, referring to FIG. 7, the substrate 1 around the round hole 11 is cut for forming with a square hole 10 and a connecting portion 12 for forming with a bent supporting plate 13. Therefore, the supporting plate 13 is directly formed with a round hole 11 and is bent to be perpendicular to the substrate 1. The substrate 1 adjacent to round hole 11 may be engaged with groove 53 between the two flanges. Thus, the bulb 31 and the lamp seat 32 are fixed so as to be parallel with the substrate 1.

Figure 8A:
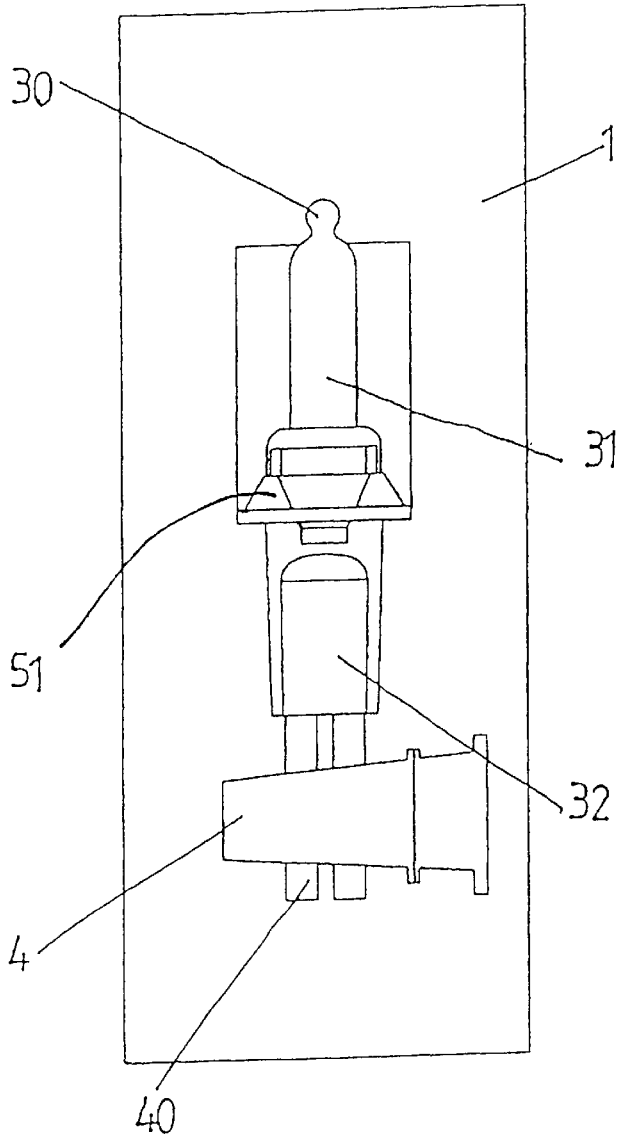
FIG. 8A is a front view of the assembly of FIG. 7.
Figure 8B:
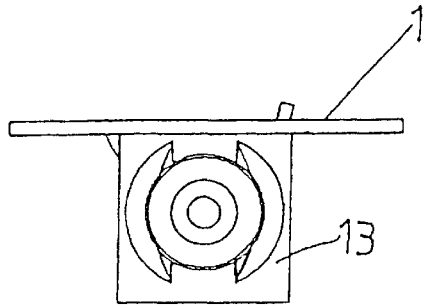
FIG. 8B is a top view of the assembly of FIG. 8A.
Figure 8C:
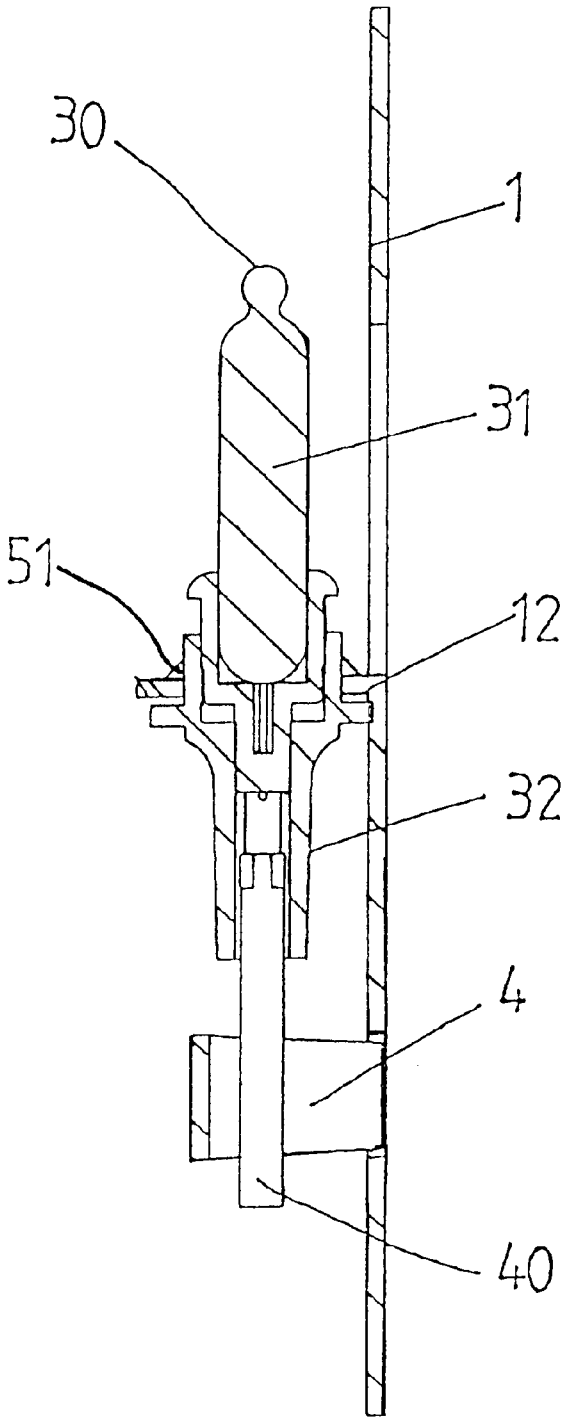
FIG. 8C is a side view of the assembly of FIG. 8A.

Referring to FIGS. 8A–8C, a long shape tongue piece 4 as shown in FIG. 4 may be formed in the substrate 1 below the supporting plate 13 for containing and fixing the conductive wire 40.

In the present invention, the substrate may be a transparent or opaque plastic plate, and may be coated with the same or different colors according to the pattern or characters in order to enhance the effect of decorating.

Figure 9:
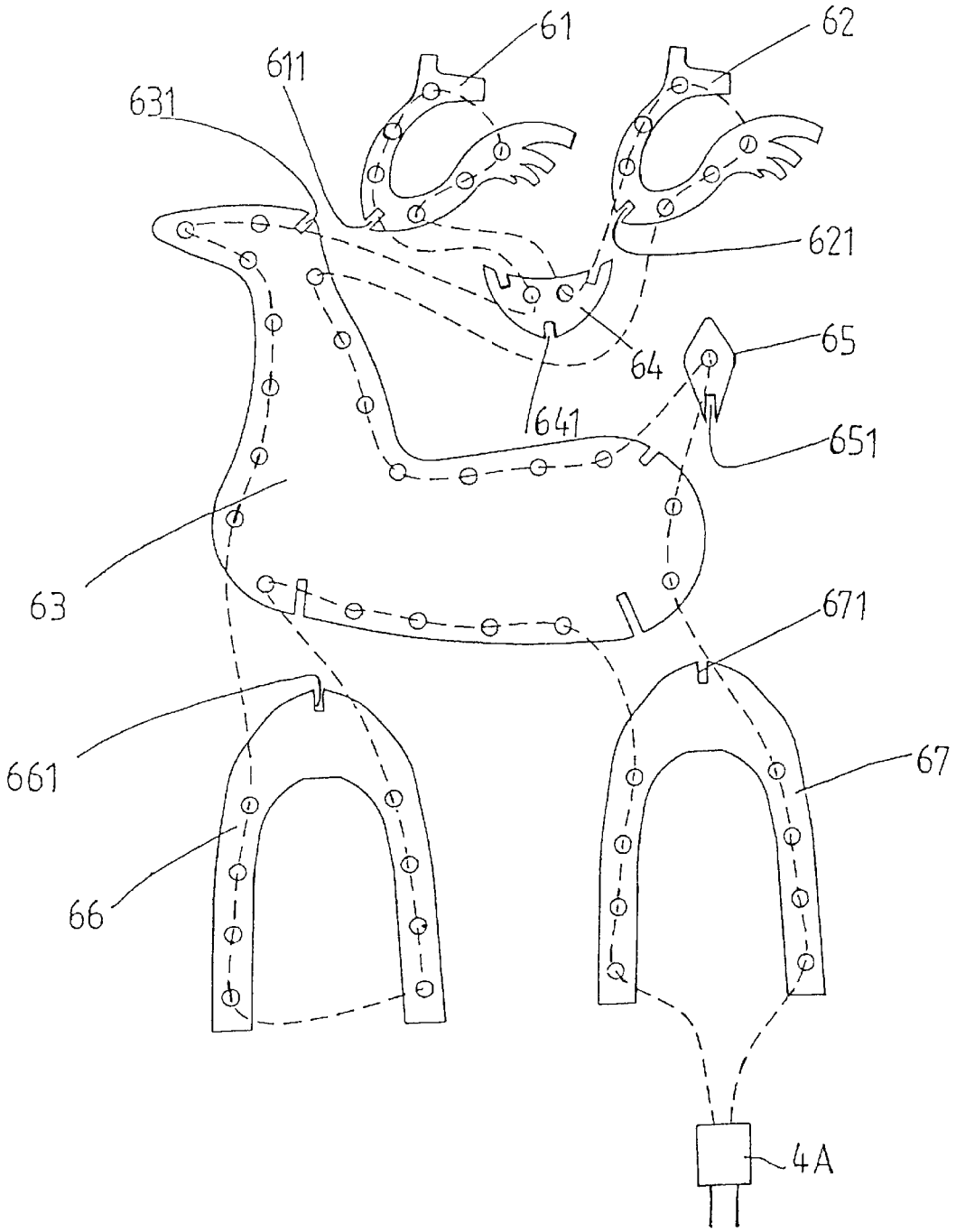
FIG. 9 is an exploded perspective view of the fourth embodiment of the present invention.
Figure 10:
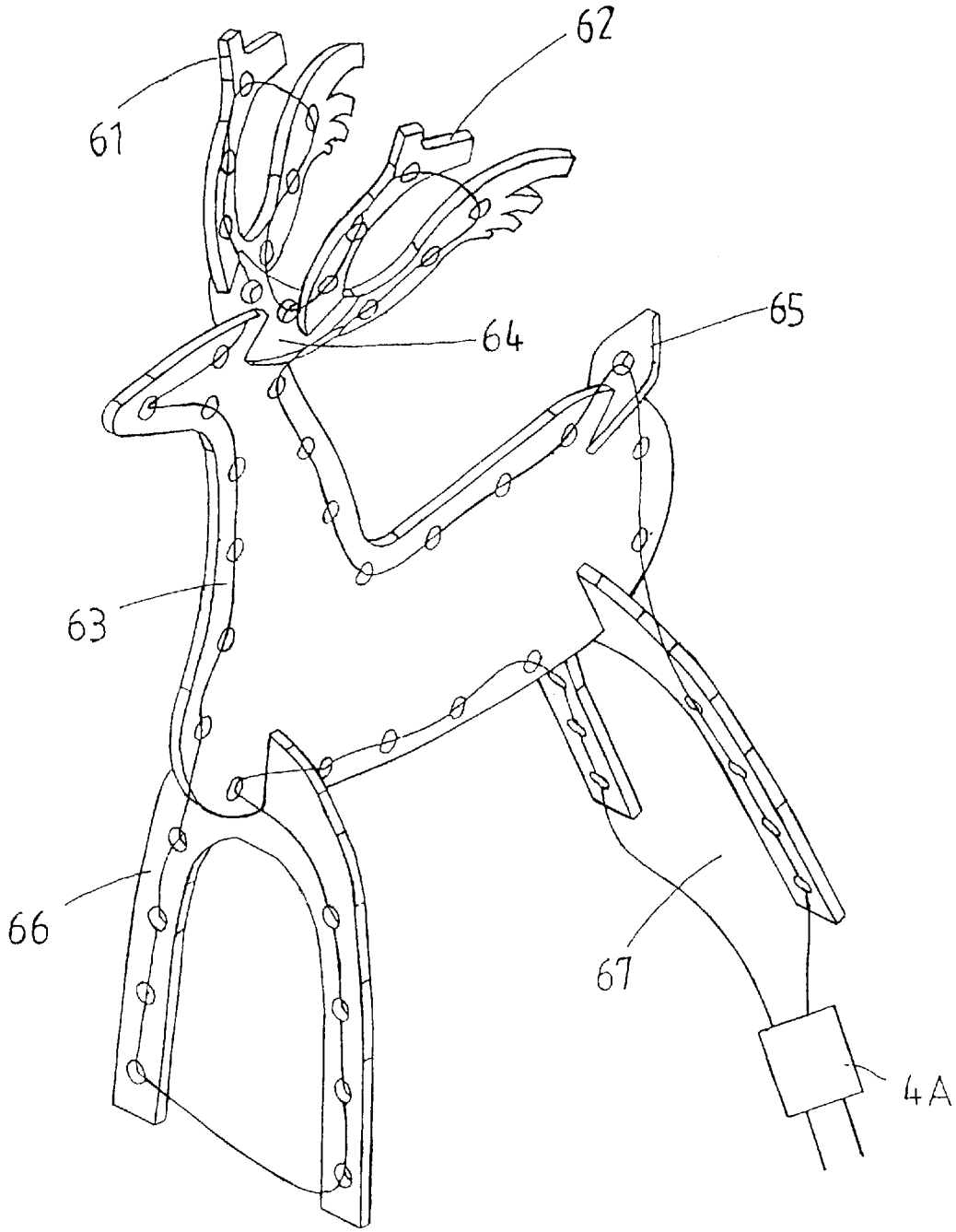
FIG. 10 is an assembled perspective view of the fourth embodiment according to the present invention.

As shown in FIGS. 9 and 10, an object with a plurality of substrates 61, 62, 63, 64, 65, 66 and 67 is formed. Each of the substrates is formed with a respective long notch, 611, 621, 631, 641, 651, 661 and 671 so that the different substrates can be engaged with each other by the notches, 611, 621, 631, 641, 651, 661, and 671 until the base portions of each of the notches 611, 621, 631, 641, 651, 661 and 671 are tightly engaged. Therefore, by the combinations of the plurality of substrates 61, 62, 63, 64, 65, 66, and 67 a three dimensional assembly is formed easily. Thereby, the lamp seat 31, lamp head 30 and bulb 32 are fixed in series and a plug is connected to the power source so as to form an illuminated three dimensional decorating object.

It is appreciated from the above description that by the decorating lamp of the present invention, the lamp seat and conductive wire can be fixed effectively and may be easily assembled.

Although the present invention has been described with reference to the preferred embodiments, it will be understood that the invention is not limited to the details described herein. Various substitutions and modifications have been suggested in the foregoing description, and others will occur to those of ordinary skill in the art. Therefore, all such substitutions and modification are intended to be embraced within the scope of the invention as defined in the appended claims.

What is claimed is:

1. An illuminated decorative assembly comprising:

a) a substrate having a plurality of elongated holes therethrough arranged in a predetermined decorative pattern, each elongated hole having opposite side edges;

b) a plurality of lamp seats each having a bulb, each lamp seat located in one of the plurality of elongated holes and having a pair of spaced apart, parallel, longitudinal flanges extending outwardly from two opposite sides whereby the opposite side edges of the associated elongated opening extend between the spaced apart longitudinal flanges so as to mount the lamp seat to the substrate such that the lamp seat and bulb are both located within the elongated hole between the opposite side edges thereof; and c) a plurality of electrical wires interconnecting the plurality of lamp seats.

2. The illuminated decorative assembly of claim 1 further comprising a hook extending outwardly from the lamp seat adjacent to one of the pair of flanges such that at least one electrical wire is retained between the hook and the adjacent flange.

3. The illuminated decorative assembly of claim 1 further comprising: a tongue piece cut from the substrate and leaving a root portion connected to the substrate so as to form an opening through the substrate, the tongue piece having a distal end wider than a width of the root portion; and notches formed in each side of the opening whereby the tongue piece extends over the electrical wires and the distal end is inserted into the notches to hold the electrical wires in a predetermined position on the substrate.

4. An illuminated decorative assembly comprising:

a) a substrate having a plurality of first holes therethrough arranged in a predetermined decorative pattern;

b) a plurality of supporting plates extending perpendicularly from the substrate adjacent to the plurality of first holes, each supporting plate having a second hole:

c) a plurality of lamp seats each having a bulb, each lamp seat located in one of the plurality of second holes, and having a first transverse flange extending outwardly therefrom, the first flange having at least one circumferential gap, and a second transverse flange extending outwardly therefrom, spaced from and parallel to the first transverse flange, the second transverse flange being circumferentially aligned with the gap, whereby the first and second transverse flanges engage opposite sides of an edge portion of the supporting plate bounding the second hole so as to mount the lamp seat to the supporting plate wherein the bulb and the lamp seat are parallel to the substrate; and, d) a plurality of electrical wires interconnecting the plurality of lamp seats.

5. The illuminated decorative assembly of claim 4 further comprising: a tongue piece cut from the substrate and leaving a root portion connected to the substrate so as to form an opening through the substrate, the tongue piece having a distal end wider than a width of the root portion; and notches formed in each side of the opening whereby the tongue piece extends over the electrical wires and the distal end is inserted into the notches to hold the electrical wires in a predetermined position on the substrate.

6. The illuminated decorative assembly of claim 4 comprising a plurality of substrates, attached together to form a three dimensional decorative article.

7. The illuminated decorative assembly of claim 1 comprising a plurality of substrates, attached together to form a three dimensional decorative article.

* * * * *